US012188707B2

(12) United States Patent
Wu et al.

(10) Patent No.: US 12,188,707 B2
(45) Date of Patent: Jan. 7, 2025

(54) EVAPORATOR FOR AN ICE MAKING ASSEMBLY

(71) Applicant: Haier US Appliance Solutions, Inc., Wilmington, DE (US)

(72) Inventors: Jin Wu, Shanghai (CN); Bo Yan, Shanghai (CN); Yayu Song, Shanghai (CN); Eddy Zhou, Shanghai (CN); Michael Zhou, Shanghai (CN); Roy Teng, Shanghai (CN); Zhijun Shi, Shanghai (CN); Jason Jiang, Shanghai (CN); Brent Junge, Evansville, IN (US); Justin Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/799,555

(22) PCT Filed: Jul. 9, 2021

(86) PCT No.: PCT/CN2021/105373

§ 371 (c)(1),
(2) Date: Aug. 12, 2022

(87) PCT Pub. No.: WO2023/279354

PCT Pub. Date: Jan. 12, 2023

(65) Prior Publication Data

US 2024/0183599 A1 Jun. 6, 2024

(51) Int. Cl.
*F25C 1/045* (2018.01)
*F25B 39/02* (2006.01)
(Continued)

(52) U.S. Cl.
CPC ..... *F25C 5/10* (2013.01); *F25B 39/02* (2013.01); *F25B 49/02* (2013.01)

(58) Field of Classification Search
CPC ..... F25C 5/10; F25C 2400/14; F25C 1/045; F25B 39/02; F25B 49/02
See application file for complete search history.

(56) References Cited

U.S. PATENT DOCUMENTS 4,970,877 A * 11/1990 Dimijian ..... F25C 1/12 62/344
6,502,416 B2 1/2003 Kawasumi et al.
(Continued)

FOREIGN PATENT DOCUMENTS

CN 1645018 A 2/2011
CN 102620495 A 9/2013
(Continued)

OTHER PUBLICATIONS

International Search Report Corresponding to Application No. PCT/CN2021/105373 on Mar. 31, 2022.

*Primary Examiner* — Ana M Vazquez
(74) *Attorney, Agent, or Firm* — Dority & Manning, P.A.

(57) ABSTRACT

An ice making assembly includes a mold body defining an ice-making cavity. An evaporator is coupled to the mold body. The evaporator includes a cap positioned on the mold body such that an open end of the cap is positioned at the mold body. An inlet tube is mounted to the cap. An outlet tube is also mounted to the cap. An evaporation chamber is formed between the cap and the mold body. The inlet tube is configured for directing a flow of refrigerant into the evaporation chamber, and the outlet tube configured for directing the flow of refrigerant out of the evaporation chamber.

16 Claims, 11 Drawing Sheets

(51) Int. Cl.
*F25B 49/02* (2006.01)
*F25C 5/10* (2006.01)

(56) References Cited

U.S. PATENT DOCUMENTS

| | | | |
|---|---|---|---|
| 7,703,299 | B2 | 4/2010 | Schlosser et al. |
| 11,009,281 | B1 | 5/2021 | Kridel et al. |
| 2002/0002836 | A1 | 1/2002 | Kawasumi et al. |
| 2021/0080159 | A1 | 3/2021 | Briggs et al. |

FOREIGN PATENT DOCUMENTS

| | | | | |
|---|---|---|---|---|
| CN | 204853756 | U | | 12/2015 |
| CN | 106247717 | A | | 12/2016 |
| CN | 211695520 | U | | 10/2020 |
| CN | 112240658 | A | | 1/2021 |
| CN | 112567190 | A | | 3/2021 |
| JP | 2004132645 | A | * | 4/2004 |
| KR | 102392193 | B1 | * | 3/2022 |
| WO | WO2012091484 | A2 | | 7/2012 |

* cited by examiner

EVAPORATOR FOR AN ICE MAKING ASSEMBLY

CROSS-REFERENCE TO RELATED APPLICATIONS

The present application is the National Stage Entry of and claims the benefit of priority under 35 U.S.C. § 371 to PCT Application Serial No. PCT/CN2021/105373 filed Jul. 9, 2021 and entitled EVAPORATOR FOR AN ICE MAKING ASSEMBLY which is hereby incorporated by reference in its entirety.

FIELD OF THE INVENTION

The present subject matter relates generally to ice making appliances, and more particularly to evaporators for cooling an ice mold of an ice making appliance.

BACKGROUND OF THE INVENTION

In domestic and commercial applications, ice is often formed as solid cubes, such as crescent cubes or generally rectangular blocks. The shape of such cubes is often dictated by the mold containing water during a freezing process. For instance, an ice maker can receive liquid water, and such liquid water can freeze within the ice maker to form ice cubes. In particular, certain ice makers include a mold that defines a plurality of cavities. The plurality of cavities can be filled with liquid water, and such liquid water can freeze within the plurality of cavities to form solid ice cubes. Typical solid cubes or blocks may be relatively small in order to accommodate a large number of uses, such as temporary cold storage and rapid cooling of liquids in a wide range of sizes.

Although the typical solid cubes or blocks may be useful in a variety of circumstances, there are certain conditions in which distinct or unique ice shapes may be desirable. As an example, it has been found that relatively large ice cubes or spheres (e.g., larger than two inches in diameter) will melt slower than typical ice sizes/shapes. Slow melting of ice may be especially desirable in certain liquors or cocktails. Moreover, such cubes or spheres may provide a unique or upscale impression for the user.

Recently, ice making appliances have been developed for forming relatively large ice billets in a manner that avoids trapping impurities and gases within the billet. These appliances also use precise temperature control to avoid a dull or cloudy finish that may form on the exterior surfaces of an ice billet, e.g., during rapid freezing of the ice cube. In addition, in order to ensure that a shaped or final ice cube or sphere is substantially clear, many systems form solid ice billets that are substantially bigger (e.g., 50% larger in mass or volume) than a desired final ice cube or sphere. Along with being generally inefficient, this may significantly increase the amount of time and energy required to melt or shape an initial ice billet into a final cube or sphere.

Conventional ice making assemblies for forming large billets of ice often experience issues keeping the ice mold cool enough to freeze through the thickness of the large ice billet, particularly toward the bottom of the ice billet or at regions farthest away from the evaporator. Accordingly, further improvements in the field of ice making would be desirable. In particular, an evaporator assembly that quickly and efficiently cools an ice mold of an ice making assembly would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice making assembly includes a plurality of mold bodies. Each of the plurality of mold bodies defines a respective ice-making cavity. An evaporator is coupled to the plurality of mold bodies. The evaporator includes a plurality of caps. Each of the plurality of caps is positioned on a respective one of plurality of mold bodies such that an open end of each of the plurality of caps is positioned at the respective one of the plurality of mold bodies. An inlet tube has a plurality of branches. Each of the plurality of branches of the inlet tube is mounted to a respective one of the plurality of caps. An outlet tube also has a plurality of branches. Each of the plurality of branches of the outlet tube is mounted to a respective one of the plurality of caps. A respective evaporation chamber is formed between each of the plurality of caps and the respective one of plurality of mold bodies. The inlet tube is configured for directing a flow of refrigerant into the evaporation chambers, and the outlet tube is configured for directing the flow of refrigerant out of the evaporation chambers.

In another exemplary aspect of the present disclosure, an ice making assembly includes a mold body defining an ice-making cavity. An evaporator is coupled to the mold body. The evaporator includes a cap positioned on the mold body such that an open end of the cap is positioned at the mold body. An inlet tube is mounted to the cap. An outlet tube is also mounted to the cap. An evaporation chamber is formed between the cap and the mold body. The inlet tube is configured for directing a flow of refrigerant into the evaporation chamber, and the outlet tube configured for directing the flow of refrigerant out of the evaporation chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
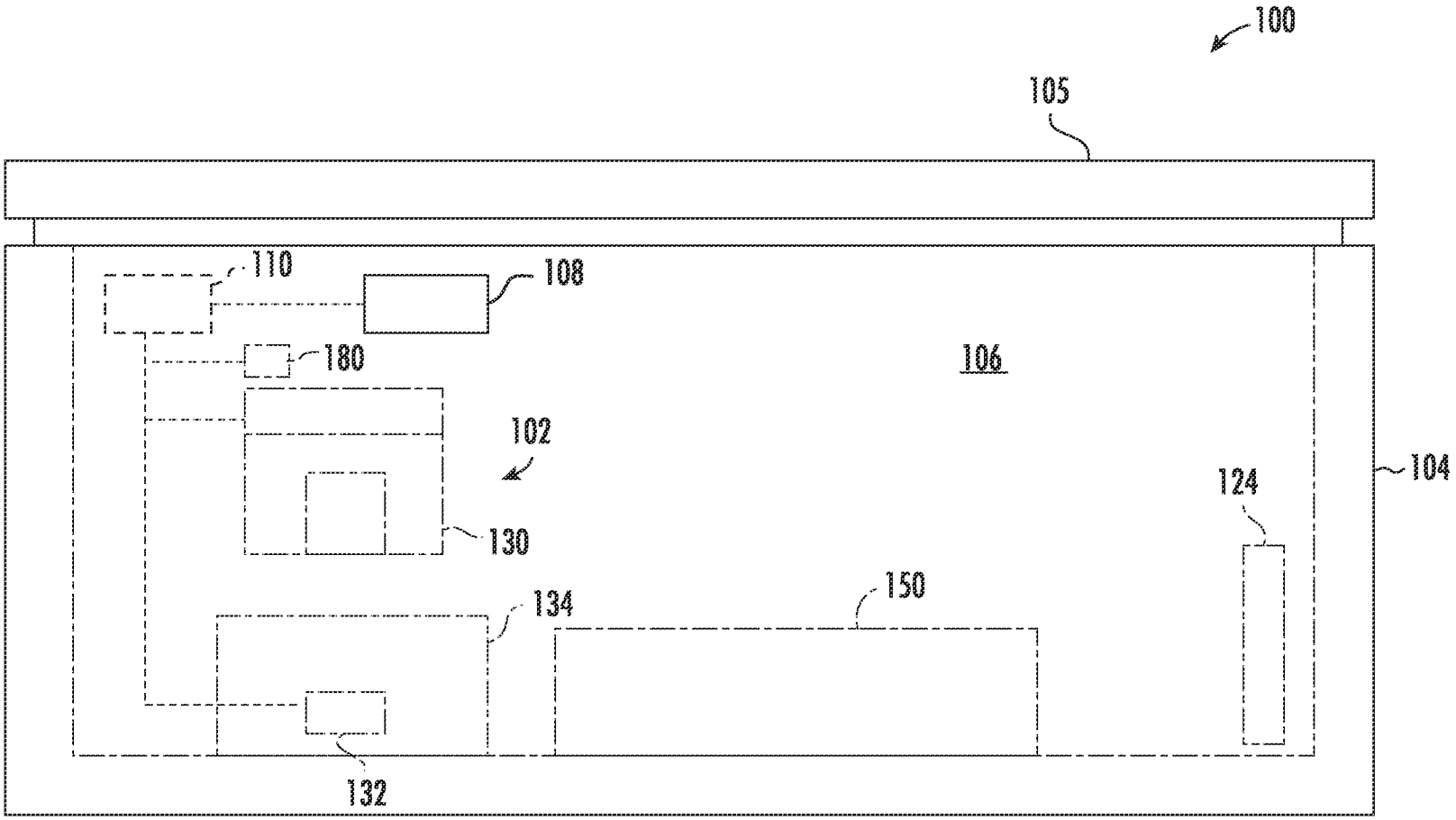
FIG. 1 is a side plan view of an ice making appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
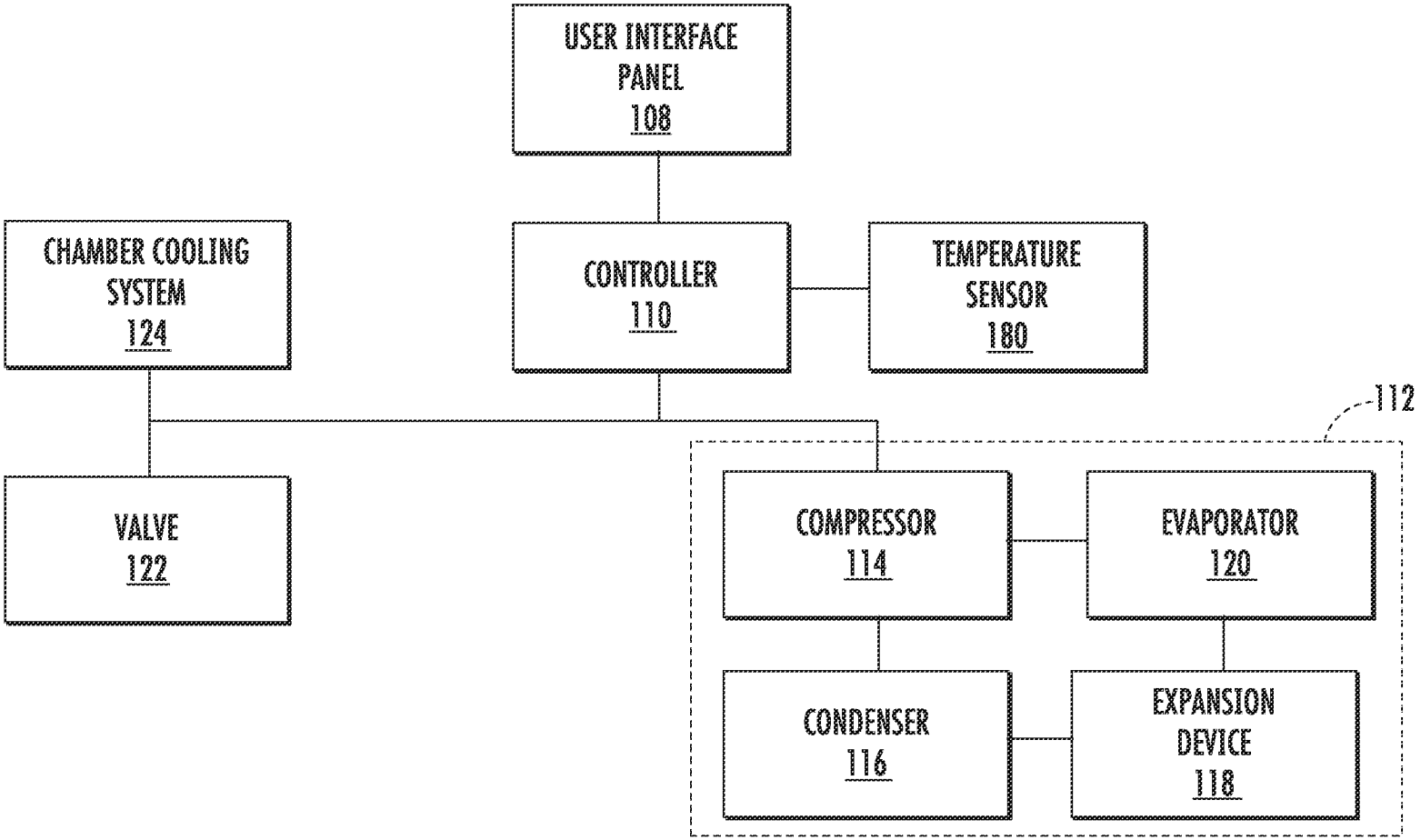
FIG. 2 is a schematic view of an ice making assembly according to exemplary embodiments of the present disclosure.
Figure 3:
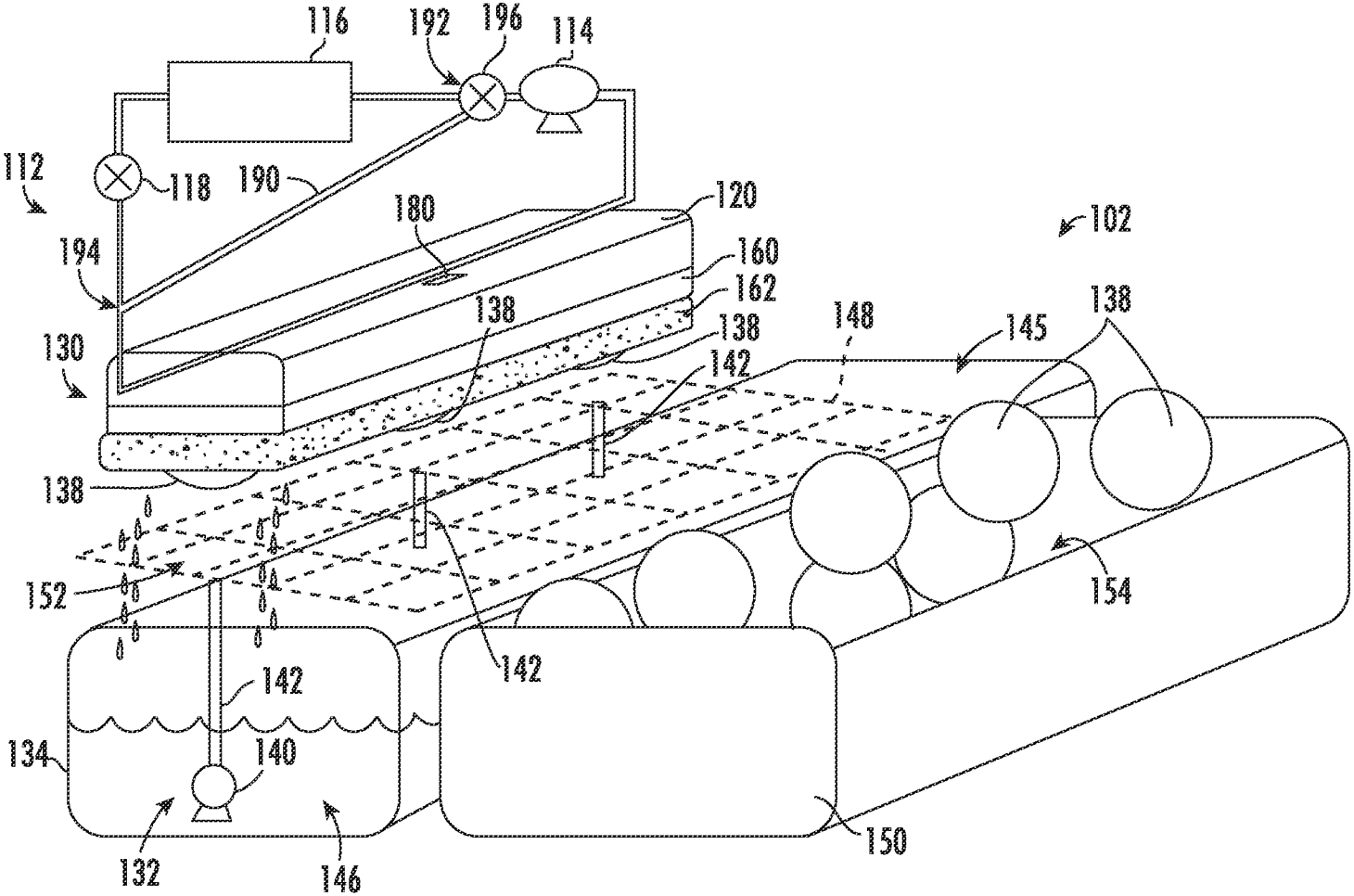
FIG. 3 is a simplified perspective view of an ice making assembly according to exemplary embodiments of the present disclosure.

Turning now to FIGS. 1 through 3, an ice making appliance 100 includes an ice making assembly 102. Generally, ice making appliance 100 includes a cabinet 104 (e.g., insulated housing). As shown, cabinet 104 defines one or more chilled chambers, such as a freezer chamber 106. In certain embodiments, such as those illustrated by FIG. 1, ice making appliance 100 is understood to be formed as, or as part of, a stand-alone freezer appliance. It is recognized, however, that additional or alternative embodiments may be provided within the context of other refrigeration appliances. For instance, the benefits of the present disclosure may apply to any type or style of a refrigerator appliance that includes a freezer chamber (e.g., a top mount refrigerator appliance, a bottom mount refrigerator appliance, a side-by-side style refrigerator appliance, etc.). Consequently, the description set forth herein is for illustrative purposes only and is not intended to be limiting in any aspect to any particular chamber configuration.

Ice making appliance 100 generally includes an ice making assembly 102 on or within freezer chamber 106. In some embodiments, ice making appliance 100 includes a door 105 that is rotatably attached to cabinet 104 (e.g., at a top portion thereof). As would be understood, door 105 may selectively cover an opening defined by cabinet 104. For instance, door 105 may rotate on cabinet 104 between an open position permitting access to freezer chamber 106 and a closed position restricting access to freezer chamber 106.

A user interface panel 108 is provided for controlling the mode of operation. For example, user interface panel 108 may include a plurality of user inputs (not labeled), such as a touchscreen or button interface, for selecting a desired mode of operation. Operation of ice making appliance 100 can be regulated by a controller 110 that is operatively coupled to user interface panel 108 or various other components, as will be described below. User interface panel 108 provides selections for user manipulation of the operation of ice making appliance 100 such as (e.g., selections regarding chamber temperature, ice making speed, or other various options). In response to user manipulation of user interface panel 108, or one or more sensor signals, controller 110 may operate various components of the ice making appliance 100 or ice making assembly 102.

Controller 110 may include a memory (e.g., non-transitive memory) and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry, such as switches, amplifiers, integrators, comparators, flip-flops, AND gates, and the like, to perform control functionality instead of relying upon software).

Controller 110 may be positioned in a variety of locations throughout ice making appliance 100. In optional embodiments, controller 110 is located within the user interface panel 108. In other embodiments, the controller 110 may be positioned at any suitable location within ice making appliance 100, such as for example within cabinet 104. Input/output ("I/O") signals may be routed between controller 110 and various operational components of ice making appliance 100. For example, user interface panel 108 may be in communication with controller 110 via one or more signal lines or shared communication busses.

As illustrated, controller 110 may be in communication with the various components of ice making assembly 102 and may control operation of the various components. For example, various valves, switches, etc. may be actuatable based on commands from the controller 110. As discussed, user interface panel 108 may additionally be in communication with the controller 110. Thus, the various operations may occur based on user input or automatically through controller 110 instruction.

Generally, as shown in FIG. 2, ice making appliance 100 includes a sealed refrigeration system 112 for executing a vapor compression cycle for cooling water within ice making appliance 100 (e.g., within freezer chamber 106). Sealed refrigeration system 112 includes a compressor 114, a condenser 116, an expansion device 118, and an evaporator 120 connected in fluid series and charged with a refrigerant. As will be understood by those skilled in the art, sealed refrigeration system 112 may include additional components (e.g., one or more directional flow valves or an additional evaporator, compressor, expansion device, or condenser). Moreover, at least one component (e.g., evaporator 120) is provided in thermal communication (e.g., conductive thermal communication) with an ice mold or mold body 130 (FIG. 3) to cool mold body 130, such as during ice making operations. Optionally, evaporator 120 is mounted within freezer chamber 106, as generally illustrated in FIG. 1.

Within sealed refrigeration system 112, gaseous refrigerant flows into compressor 114, which operates to increase the pressure of the refrigerant. This compression of the refrigerant raises its temperature, which is lowered by passing the gaseous refrigerant through condenser 116. Within condenser 116, heat exchange with ambient air takes place so as to cool the refrigerant and cause the refrigerant to condense to a liquid state.

Expansion device 118 (e.g., a mechanical valve, capillary tube, electronic expansion valve, or other restriction device) receives liquid refrigerant from condenser 116. From expansion device 118, the liquid refrigerant enters evaporator 120. Upon exiting expansion device 118 and entering evaporator 120, the liquid refrigerant drops in pressure and vaporizes. Due to the pressure drop and phase change of the refrigerant, evaporator 120 is cool relative to freezer chamber 106 and liquid water. As such, cooled water and ice or air is produced and refrigerates ice making appliance 100 or freezer chamber 106. Thus, evaporator 120 is a heat exchanger which transfers heat from water or air in thermal communication with evaporator 120 to refrigerant flowing through evaporator 120.

Optionally, as described in more detail below, one or more directional valves may be provided (e.g., between compressor 114 and condenser 116) to selectively redirect refrigerant through a bypass line connecting the directional valve or valves to a point in the fluid circuit downstream from the expansion device 118 and upstream from the evaporator 120. In other words, the one or more directional valves may permit refrigerant to selectively bypass the condenser 116 and expansion device 118.

Ice making appliance 100 may further include a valve 122 for regulating a flow of liquid water to ice making assembly 102. For example, valve 122 may be selectively adjustable between an open configuration and a closed configuration. In the open configuration, valve 122 permits a flow of liquid water to ice making assembly 102 (e.g., to a water dispenser 132 or a water basin 134 of ice making assembly 102). Conversely, in the closed configuration, valve 122 hinders the flow of liquid water to ice making assembly 102.

Ice making appliance 100 may also include a discrete chamber cooling system 124 (e.g., separate from sealed refrigeration system 112) to generally draw heat from within freezer chamber 106. For example, discrete chamber cooling system 124 may include a corresponding sealed refrigeration circuit (e.g., including a unique compressor, condenser, evaporator, and expansion device) or air handler (e.g., axial fan, centrifugal fan, etc.) configured to motivate a flow of chilled air within freezer chamber 106.

Figure 4:
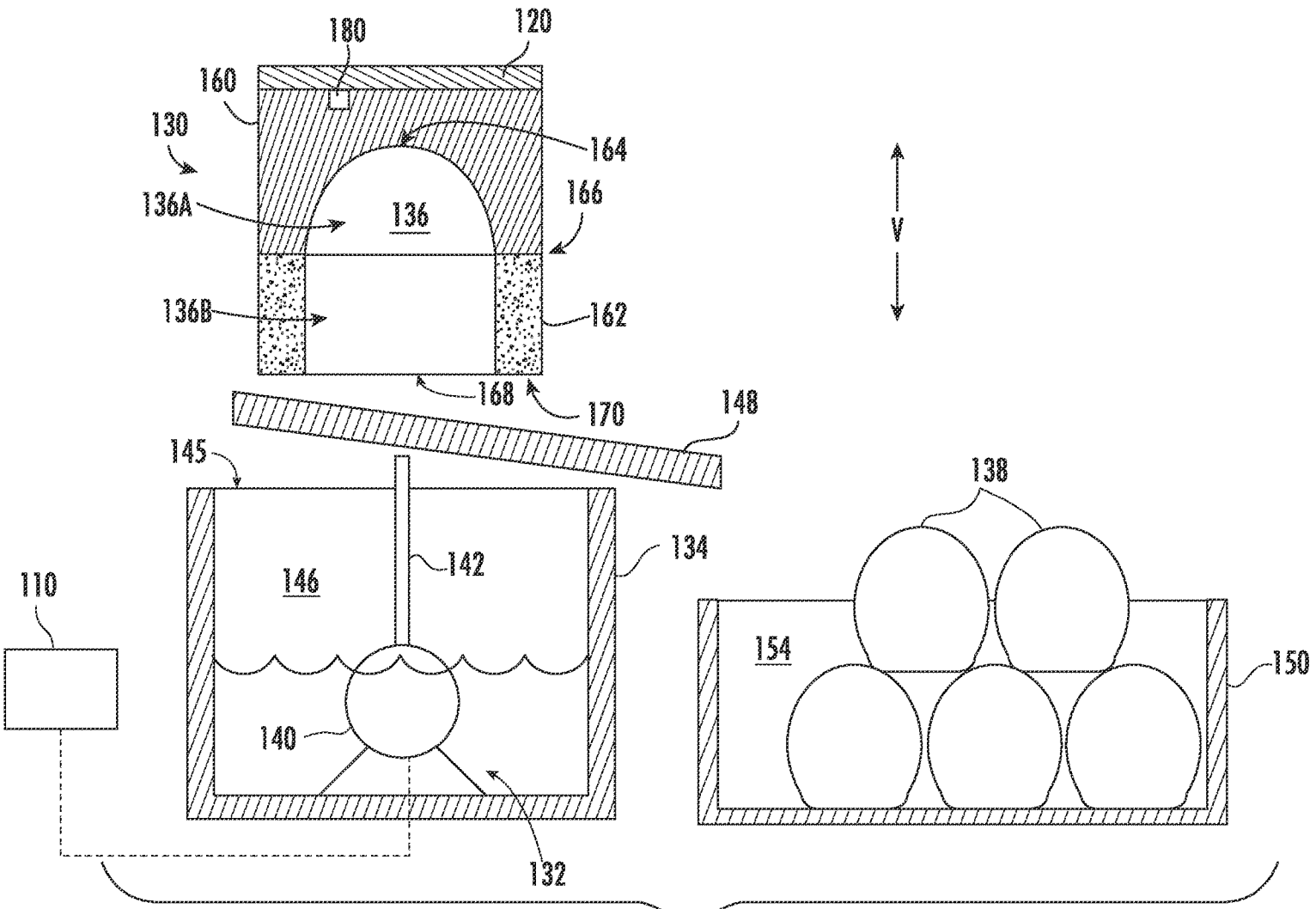
FIG. 4 is a cross-sectional, schematic view of the exemplary ice making assembly of FIG. 3.

With reference to FIGS. 3 and 4, ice making assembly 102 includes a mold body 130 that defines a mold cavity 136 within which an ice billet 138 may be formed. Optionally, a plurality of mold cavities 136 may be defined by mold body 130 and spaced apart from each other (e.g., perpendicular to a vertical direction V). One or more portions of sealed refrigeration system 112 may be in thermal communication with mold body 130. In particular, evaporator 120 may be placed on or in contact (e.g., conductive contact) with a portion of mold body 130. During use, mold body 130 may reject heat to evaporator 120. Moreover, a water dispenser 132 positioned below mold body 130 may selectively direct the flow of water into mold cavity 136. Generally, water dispenser 132 includes a water pump 140 and at least one nozzle 142 directed (e.g., vertically upward) toward mold cavity 136. In embodiments wherein multiple discrete mold cavities 136 are defined by mold body 130, water dispenser 132 may include a plurality of nozzles 142 or fluid pumps vertically aligned with the plurality mold cavities 136. For instance, each mold cavity 136 may be vertically aligned with a discrete nozzle 142.

A water basin 134 may be positioned below mold body 130 (e.g., directly beneath mold cavity 136 along the vertical direction V). Water basin 134 may include a liquid-impermeable body and that defines a top opening 145 and interior volume 146 in fluid communication with mold cavity 136. When assembled, fluids, such as excess water falling from mold cavity 136, may pass into interior volume 146 of water basin 134 through top opening 145. In certain embodiments, one or more portions of water dispenser 132 are positioned within water basin 134 (e.g., within interior volume 146). As an example, water pump 140 may be mounted within water basin 134 in fluid communication with interior volume 146. Thus, water pump 140 may selectively draw water from interior volume 146 (e.g., to be dispensed by spray nozzle 142). Nozzle 142 may extend (e.g., vertically upward) from water pump 140 through interior volume 146. In alternative example embodiments, water pump 140 may be positioned outside of water basin 134 and in fluid communication with interior volume 146 and nozzle 142, e.g., via suitable pipes, hoses, etc.

A guide ramp 148 may be positioned between mold body 130 and water basin 134 along the vertical direction V. For example, guide ramp 148 may include a ramp surface that extends at a negative angle (e.g., relative to a horizontal direction) from a location beneath mold cavity 136 to another location spaced apart from water basin 134 (e.g., horizontally). Guide ramp 148 may extend to or terminates above an ice bin 150. Additionally or alternatively, guide ramp 148 may define a perforated portion 152 that is, for example, vertically aligned between mold cavity 136 and nozzle 142 or between mold cavity 136 and interior volume 146. One or more apertures are generally defined through guide ramp 148 at perforated portion 152. Fluids, such as water, may thus generally pass through perforated portion 152 of guide ramp 148 (e.g., along the vertical direction between mold cavity 136 and interior volume 146).

As shown, ice bin 150 generally defines a storage volume 154 and may be positioned below mold body 130 and mold cavity 136. Ice billets 138 formed within mold cavity 136 may be expelled from mold body 130 and subsequently stored within storage volume 154 of ice bin 150 (e.g., within freezer chamber 106). In some example embodiments, ice bin 150 is positioned within freezer chamber 106 and horizontally spaced apart from water basin 134, water dispenser 132, or mold body 130. Guide ramp 148 may span the horizontal distance between mold body 130 and ice bin 150. As ice billets 138 descend or fall from mold cavity 136, the ice billets 138 may thus be motivated (e.g., by gravity) toward ice bin 150.

Figure 5:
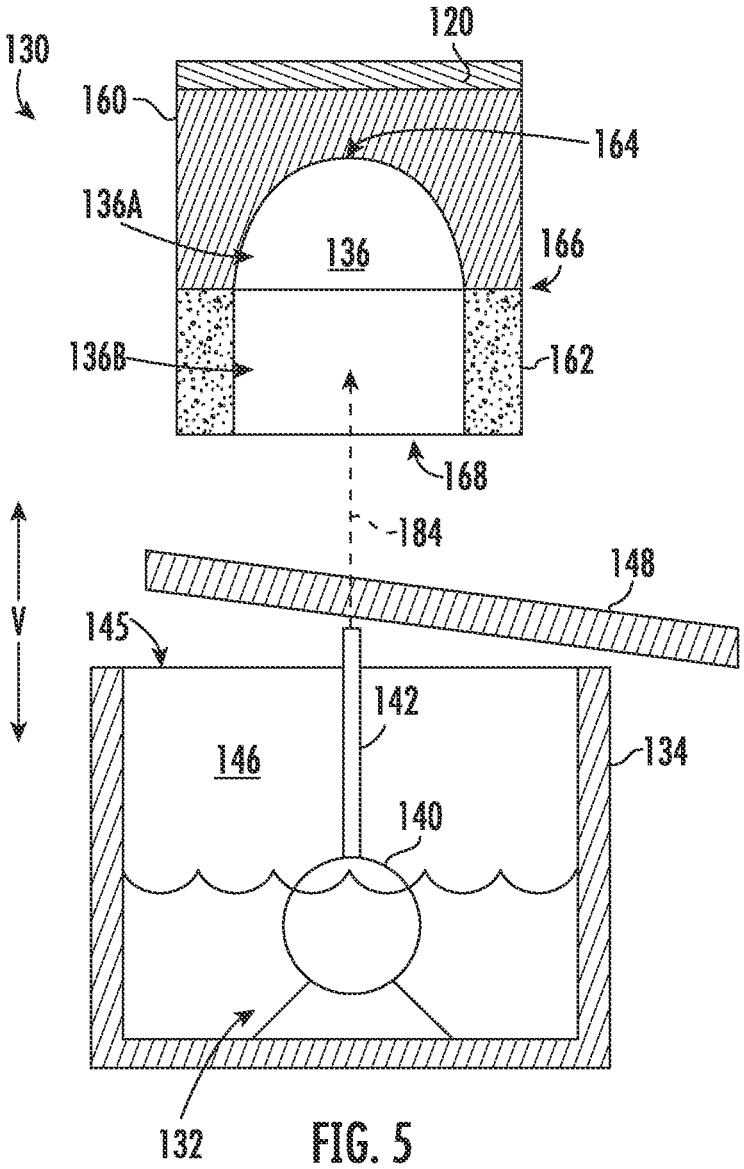
FIG. 5 is a cross-sectional, schematic view of a portion of the exemplary ice making assembly of FIG. 3 during an ice forming operation.

Turning now generally to FIGS. 4 and 5, exemplary ice forming operations of ice making assembly 102 will be described. As shown, mold body 130 is formed from discrete conductive ice mold 160 and insulation jacket 162. Generally, insulation jacket 162 extends downward from (e.g., directly from) conductive ice mold 160. For instance, insulation jacket 162 may be fixed to conductive ice mold 160 through one or more suitable adhesives or attachment fasteners (e.g., bolts, latches, mated prongs-channels, etc.) positioned or formed between conductive ice mold 160 and insulation jacket 162.

Together, conductive ice mold 160 and insulation jacket 162 may define mold cavity 136. For instance, conductive ice mold 160 may define an upper portion 136A of mold cavity 136 while insulation jacket 162 defines a lower portion 136B of mold cavity 136. Upper portion 136A of mold cavity 136 may extend between a nonpermeable top end 164 and an open bottom end 166. Additionally or alternatively, upper portion 136A of mold cavity 136 may be curved (e.g., hemispherical) in open fluid communication with lower portion 136B of mold cavity 136. Lower portion 136B of mold cavity 136 may be a vertically open passage that is aligned (e.g., in the vertical direction V) with upper portion 136A of mold cavity 136. Thus, mold cavity 136 may extend along the vertical direction between a mold opening 168 at a bottom portion or bottom surface 170 of insulation jacket 162 to top end 164 within conductive ice mold 160. In some such embodiments, mold cavity 136 defines a constant diameter or horizontal width from lower portion 136B to upper portion 136A. When assembled, fluids, such as water may pass to upper portion 136A of mold cavity 136 through lower portion 136B of mold cavity 136 (e.g., after flowing through the bottom opening defined by insulation jacket 162).

Conductive ice mold 160 and insulation jacket 162 may be formed, at least in part, from two different materials. Conductive ice mold 160 is generally formed from a thermally conductive material (e.g., metal, such as copper, aluminum, or stainless steel, including alloys thereof) while insulation jacket 162 is generally formed from a thermally insulating material (e.g., insulating polymer, such as a synthetic silicone configured for use within subfreezing temperatures without significant deterioration). In alternative example embodiments, insulation jacket 162 may be formed using polyethylene terephthalate (PET) plastic or any other suitable material. In certain example embodiments, conductive ice mold 160 is formed from material having a greater amount of water surface adhesion than the material from which insulation jacket 162 is formed. Water freezing within mold cavity 136 may be prevented from extending horizontally along bottom surface 170 of insulation jacket 162.

Advantageously, an ice billet within mold cavity 136 may be prevented from mushrooming beyond the bounds of mold cavity 136. Moreover, if multiple mold cavities 136 are defined within mold body 130, ice making assembly 102 may advantageously prevent a connecting layer of ice from being formed along the bottom surface 170 of insulation jacket 162 between the separate mold cavities 136 (and ice billets therein). Further advantageously, the present example embodiments may ensure an even heat distribution across an ice billet within mold cavity 136. Cracking of the ice billet or formation of a concave dimple at the bottom of the ice billet may thus be prevented.

Although an exemplary mold body 130 is described above, it should be appreciated that variations and modifications may be made to mold body 130 while remaining within the scope of the present subject matter. For example, the size, number, position, and geometry of mold cavities 136 may vary. Indeed, aspects of the present subject matter may be modified and implemented in a different ice making apparatus or process while remaining within the scope of the present subject matter.

In some example embodiments, one or more sensors are mounted on or within ice mold 160. As an example, a temperature sensor 180 may be mounted adjacent to ice mold 160. Temperature sensor 180 may be electrically coupled to controller 110 and configured to detect the temperature within ice mold 160. Temperature sensor 180 may be formed as any suitable temperature detecting device, such as a thermocouple, thermistor, etc. Although temperature sensor 180 is illustrated as being mounted to ice mold 160, it should be appreciated that according to alternative example embodiments, temperature sensor may be positioned at any other suitable location for providing data indicative of the temperature of the ice mold 160. For example, temperature sensor 180 may alternatively be mounted to a coil of evaporator 120 or at any other suitable location within ice making appliance 100.

As shown, controller 110 may be in communication (e.g., electrical communication) with one or more portions of ice making assembly 102. In some example embodiments, controller 110 is in communication with one or more fluid pumps (e.g., water pump 140), compressor 114, flow regulating valves, etc. Controller 110 may be configured to initiate discrete ice making operations and ice release operations. For instance, controller 110 may alternate the fluid source spray to mold cavity 136 and a release or ice harvest process, which will be described in more detail below.

During ice making operations, controller 110 may initiate or direct water dispenser 132 to motivate an ice-building spray (e.g., as indicated at arrows 184) through nozzle 142 and into mold cavity 136 (e.g., through mold opening 168). Controller 110 may further direct sealed refrigeration system 112 (e.g., at compressor 114) (FIG. 3) to motivate refrigerant through evaporator 120 and draw heat from within mold cavity 136. As the water from the ice-building spray 184 strikes mold body 130 within mold cavity 136, a portion of the water may freeze in progressive layers from top end 164 to bottom end 166. Excess water (e.g., water within mold cavity 136 that does not freeze upon contact with mold body 130 or the frozen volume herein) and impurities within the ice-building spray 184 may fall from mold cavity 136 and, for example, to water basin 134.

Once ice billets 138 are formed within mold cavity 136, an ice release or harvest process may be performed in accordance with example embodiments of the present subject matter. Specifically, referring again to FIG. 3, sealed system 112 may further include a bypass conduit 190 that is fluidly coupled to refrigeration loop or sealed system 112 for routing a portion of the flow of refrigerant around condenser 116. In this manner, by selectively regulating the amount of relatively hot refrigerant flow that exits compressor 114 and bypasses condenser 116, the temperature of the flow of refrigerant passing into evaporator 120 may be precisely regulated.

Specifically, according to the illustrated example embodiment, bypass conduit 190 extends from a first junction 192 to a second junction 194 within sealed system 112. First junction 192 is located between compressor 114 and condenser 116, e.g., downstream of compressor 114 and upstream of condenser 116. By contrast, second junction 194 is located between condenser 116 and evaporator 120, e.g., downstream of condenser 116 and upstream of evaporator 120. Moreover, according to the illustrated example embodiment, second junction 194 is also located downstream of expansion device 118, although second junction 194 could alternatively be positioned upstream of expansion device 118. When plumbed in this manner, bypass conduit 190 provides a pathway through which a portion of the flow of refrigerant may pass directly from compressor 114 to a location immediately upstream of evaporator 120 to increase the temperature of evaporator 120.

Notably, if substantially all of the flow of refrigerant were diverted from compressor 114 through bypass conduit 190 when ice mold 160 is still very cold (e.g., below 10° F. or 20° F.), the thermal shock experienced by ice billets 138 due to the sudden increase in evaporator temperature might cause ice billets 138 to crack. Therefore, controller 110 may implement methods for slowly regulating or precisely controlling the evaporator temperature to achieve the desired mold temperature profile and harvest release time to prevent the ice billets 138 from cracking.

In this regard, for example, bypass conduit 190 may be fluidly coupled to sealed system 112 using a flow regulating device 196. Specifically, flow regulating device 196 may be used to couple bypass conduit 190 to sealed system 112 at first junction 192. In general, flow regulating device 196 may be any device suitable for regulating a flow rate of refrigerant through bypass conduit 190. For example, according to an exemplary example embodiment of the present subject matter, flow regulating device 196 is an electronic expansion device which may selectively divert a portion of the flow of refrigerant exiting compressor 114 into bypass conduit 190. According to still another example embodiment, flow regulating device 196 may be a servo-motor-controlled valve for regulating the flow of refrigerant through bypass conduit 190. According to still other example embodiments, flow regulating device 196 may be a three-way valve mounted at first junction 192 or a solenoid-controlled valve operably coupled along bypass conduit 190.

According to exemplary example embodiments of the present subject matter, controller 110 may initiate an ice release or harvest process to discharge ice billets 138 from mold cavities 136. Specifically, for example, controller 110 may first halt or prevent the ice-building spray 184 by de-energizing water pump 140. Next, controller 110 may regulate the operation of sealed system 112 to slowly increase a temperature of evaporator 120 and ice mold 160. Specifically, by increasing the temperature of evaporator 120, the mold temperature of ice mold 160 is also increased, thereby facilitating partial melting or release of ice billets 138 from mold cavities.

According to exemplary embodiments, controller 110 may be operably coupled to flow regulating device 196 for regulating a flow rate of the flow of refrigerant through bypass conduit 190. Specifically, according to an exemplary embodiment, controller 110 may be configured for obtaining a mold temperature of the mold body using temperature sensor 180. Although the term "mold temperature" is used herein, it should be appreciated that temperature sensor 180 may measure any suitable temperature within the ice making appliance 100 that is indicative of mold temperature and may be used to facilitate improved harvest of ice billets 138.

Controller 110 may further regulate the flow regulating device 196 to control the flow of refrigerant based in part on the measured mold temperature. For example, according to an exemplary embodiment, flow regulating device 196 may be regulated such that a rate of change of the mold temperature does not exceed a predetermined threshold rate. For example, this predetermined threshold rate may be any suitable rate of temperature change beyond which thermal cracking of ice billets 138 may occur. For example, according to an exemplary embodiment, the predetermined threshold rate may be approximately 1° F. per minute, about 2° F. per minute, about 3° F. per minute, or higher. According to exemplary embodiments, the predetermined threshold rate may be less than 10° F. per minute, less than 5° F. permanent, less than 2° F. per minute, or lower. In this manner, flow regulating device 196 may regulate the rate of temperature change of ice billets 138, thereby preventing thermal cracking.

In general, the sealed system 112 and methods of operation described herein are intended to regulate a temperature change of ice billets 138 to prevent thermal cracking. However, although specific control algorithms and system configurations are described, it should be appreciated that according to alternative embodiments variations and modifications may be made to such systems and methods while remaining within the scope of the present subject matter. For example, the exact plumbing of bypass conduit 190 may vary, the type or position of flow regulating device 196 may change, and different control methods may be used while remaining within scope of the present subject matter. In addition, depending on the size and shape of ice billets 138, the predetermined threshold rate and predetermined temperature threshold may be adjusted to prevent that particular set of ice billets 138 from cracking, or to otherwise facilitate an improved harvest procedure.

Referring now specifically to FIGS. 6 through 9, an exemplary plurality of mold bodies 200 and an evaporator 300 that may be used with ice making appliance 100 will be described according to exemplary embodiments of the present subject matter. Specifically, for example, mold bodies 200 may be used as mold body 130 and evaporator 300 may be used as evaporator 120 of sealed cooling system 112. Although mold bodies 200 and evaporator 300 are described herein with respect to ice making appliance 100, it should be appreciated that mold bodies 200 and evaporator 300 may be used in any other suitable ice making application or appliance.

As shown, mold bodies 200 generally includes a top wall 210 and a plurality of sidewalls 212 that extend downwardly from top wall 210. More specifically, according to the illustrated example embodiment, mold bodies 200 includes eight sidewalls 212 that include an angled portion 214 that extends away from top wall 210 and a vertical portion 216 that extends down from angled portion 214 substantially along the vertical direction V. In this manner, the top wall 210 and the plurality of sidewalls 212 form a mold cavity 218 having an octagonal cross-section when viewed in a horizontal plane.

Figure 6:
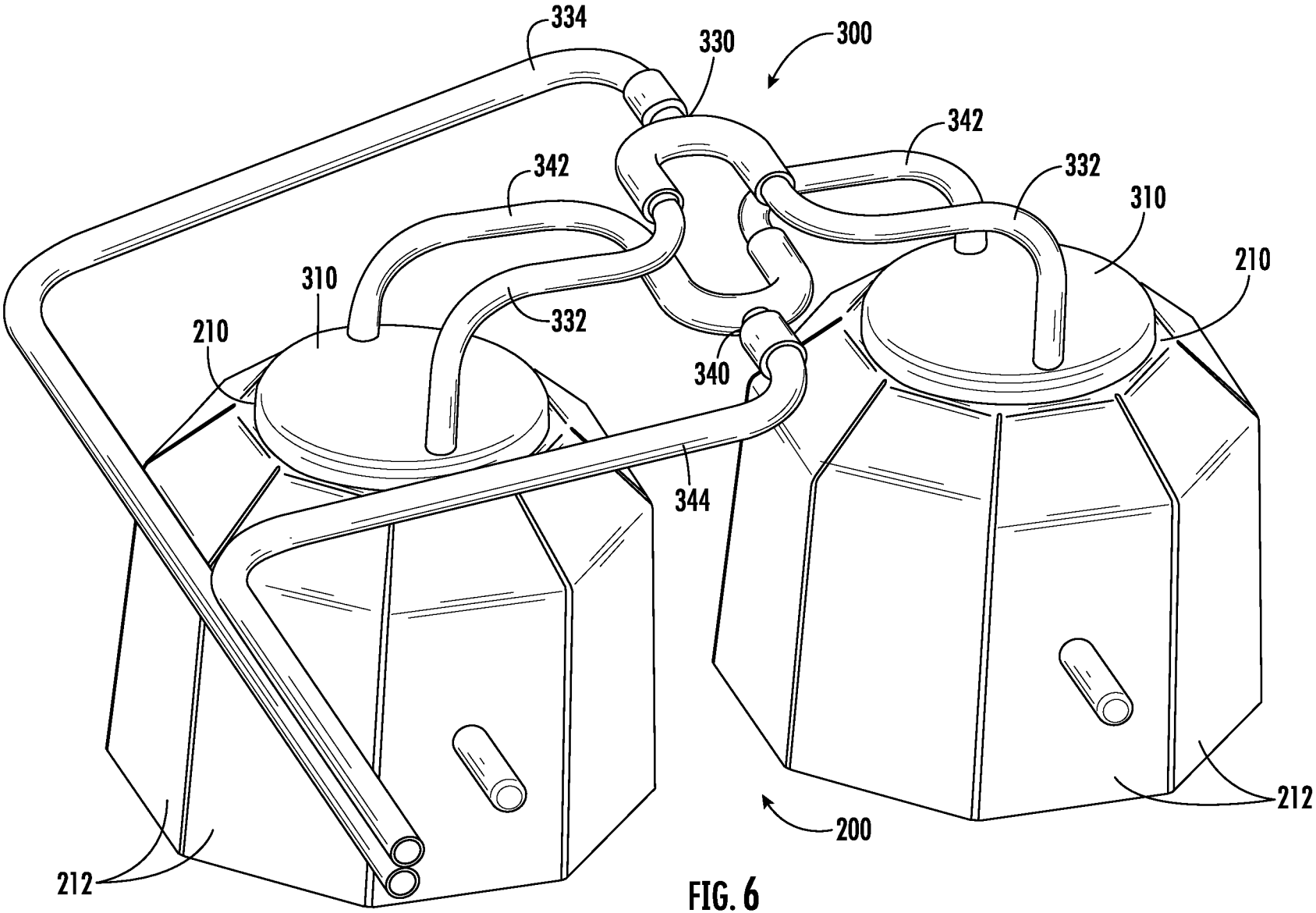
FIG. 6 is a perspective view of a mold body and an evaporator according to an example embodiment of the present subject matter.
Figure 7:
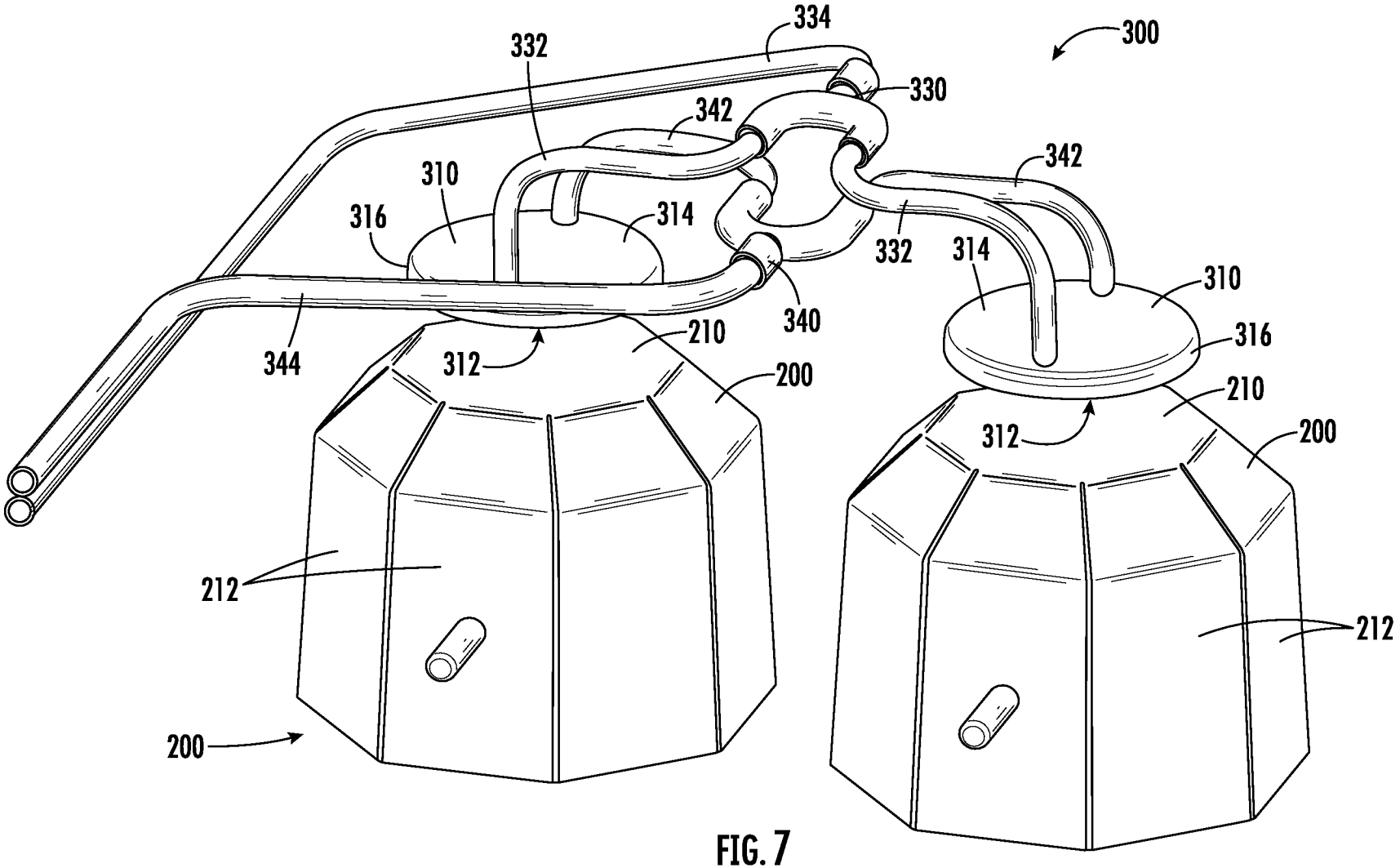
FIG. 7 is a partially exploded, perspective view of the example mold body and evaporator of FIG. 6.
Figure 8:
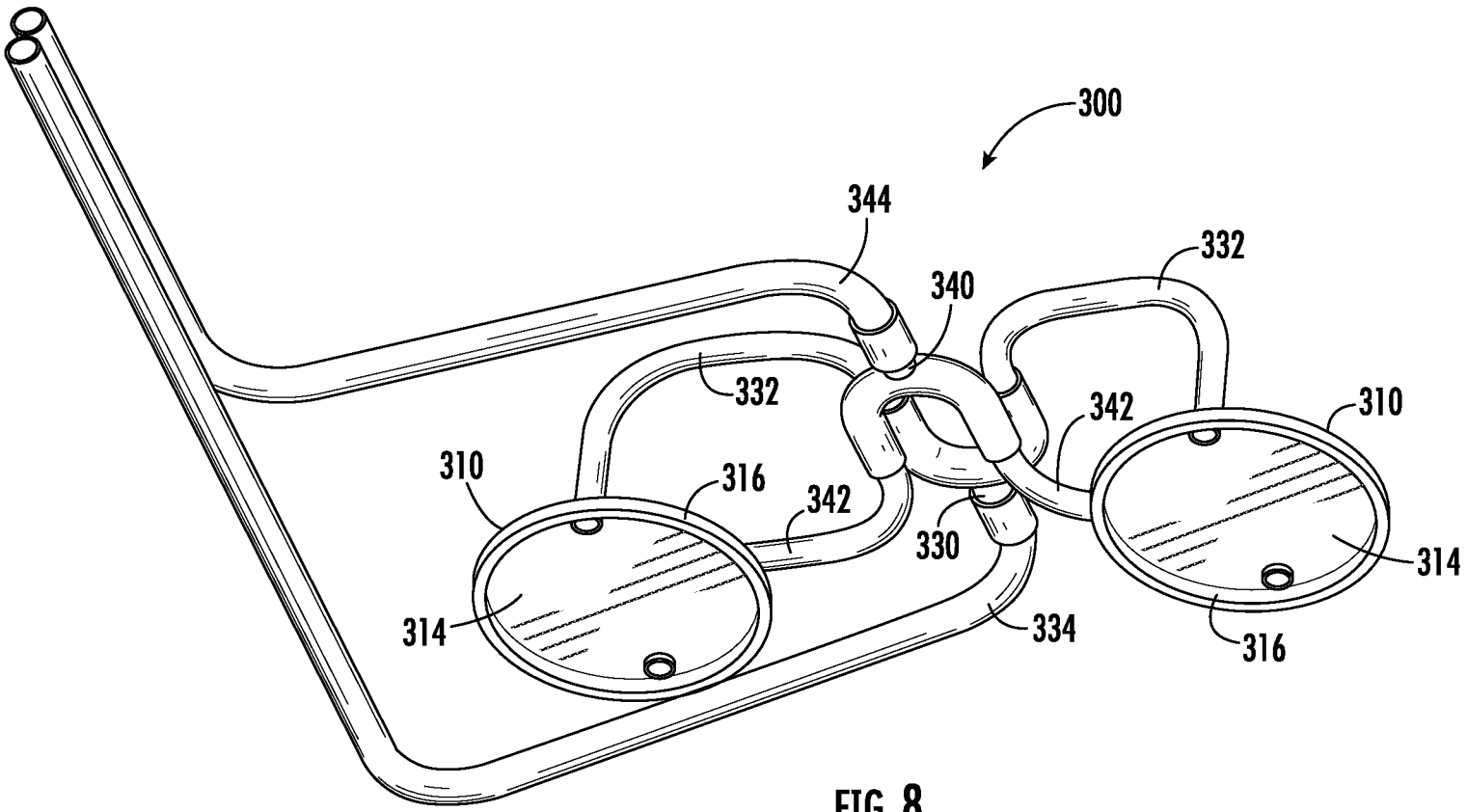
FIG. 8 is a perspective view of the example evaporator of FIG. 6.
Figure 9:
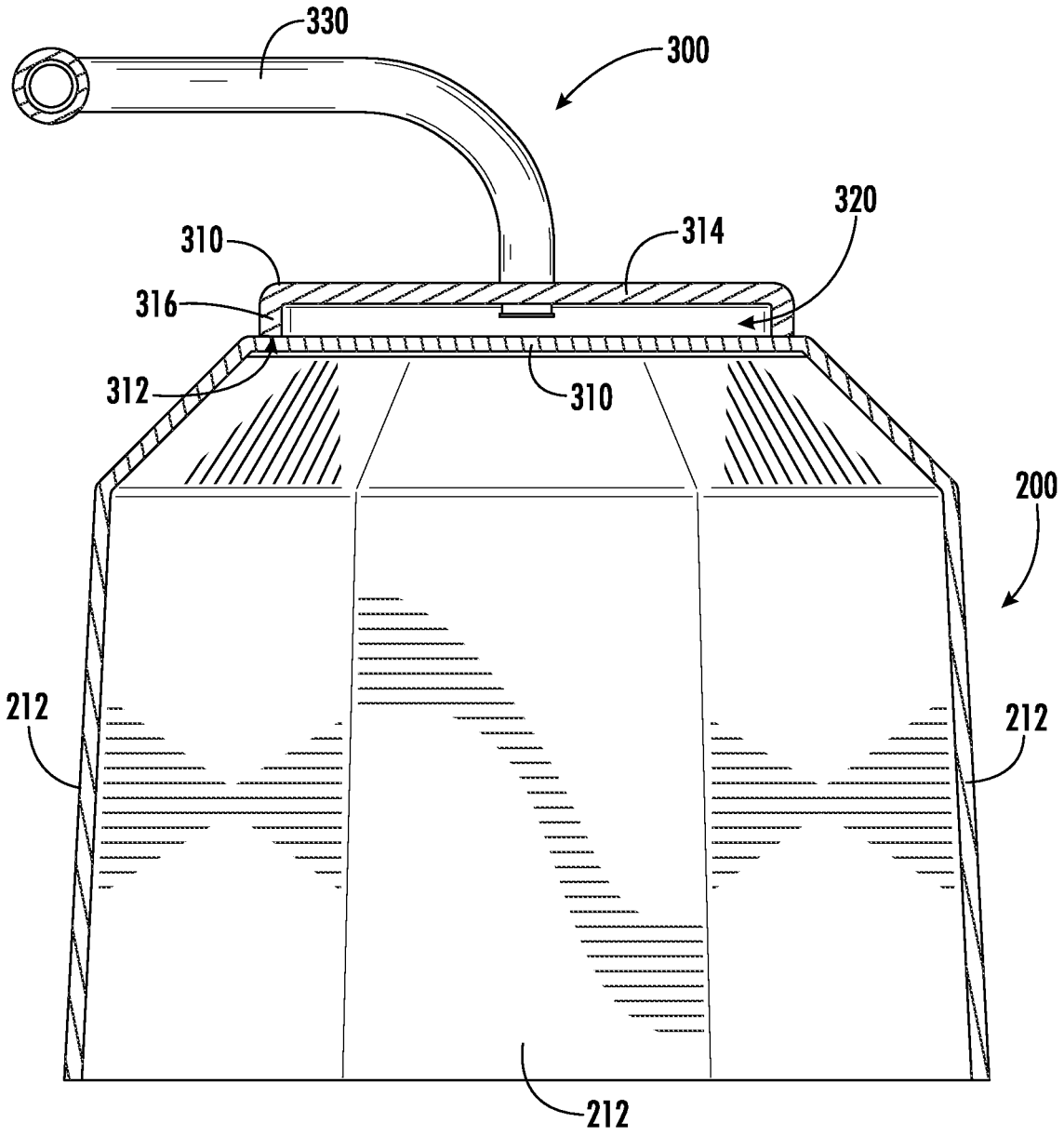
FIG. 9 is a section view of the example mold body and evaporator of FIG. 6.

In general, mold bodies 200 may be formed from any suitable material and in any suitable manner that provides sufficient thermal conductivity to transfer heat to evaporator 300 to facilitate the ice making process. According to an exemplary embodiment, mold bodies 200 is formed from a single sheet of copper. In this regard, for example, a flat sheet of copper having a constant thickness may be machined (e.g., drawn) to deform the sheet of copper into mold body 200 with top wall 210 and sidewalls 212, e.g., with the octagonal or gem shape described above. It should be appreciated that other suitable sizes, geometries, and configurations of mold bodies 200 are possible and within the scope of the present subject matter. In addition, although only two mold bodies 200 are illustrated in FIGS. 6 and 7, it should be appreciated that alternative embodiments may include any other suitable number and configuration of mold bodies 200.

Evaporator 300 is coupled to mold bodies 200. According example embodiments of the present subject matter, evaporator 300 is mounted in direct contact with the top wall 210 of mold bodies 200. In addition, evaporator assembly 300 may not be in direct contact with sidewalls 212. Evaporator 300 may include a plurality of caps 310. Each of caps 310 may be positioned on a respective one of mold bodies 200, e.g., such that an open end 312 of each cap 310 is positioned at the respective one of mold bodies 200. For example, as noted above, each of mold bodies 200 may include top wall 210 and sidewalls 212, and each of caps 319 may be positioned on top wall 210 of the respective one of mold bodies 200. In particular, each of caps 310 may be soldered or otherwise suitably fixed to the top wall 210 of the respective one of mold bodies 200.

An evaporation chamber 320 may be formed between each of caps 310 and the respective one of mold bodies 200. Mold bodies 200 may reject heat to refrigerant within evaporation chambers 320. For example, when liquid refrigerant enters evaporation chambers 320, the liquid refrigerant may drop in pressure and vaporize. Due to the pressure drop and phase change of the refrigerant, the refrigerant within evaporation chambers 320 may be cool relative to mold bodies 200 and liquid water. By rejecting heat to the refrigerant within evaporation chambers 320, liquid water within mold bodies 200 may freeze to form ice billets in the manner described above.

Each of caps 310 may include a circular top wall 314 and an arcuate sidewall 316. Arcuate sidewall 316 may extend downwardly from circular top wall 314, e.g., to open end 312 of cap 310 and/or to top wall 210 of the respective one of mold bodies 200. A diameter of circular top wall 314 and/or a diameter of arcuate sidewall 316 may be about equal to a width of the top wall 210 of the respective one of mold bodies 200. Thus, a size of circular top wall 314 and/or arcuate sidewall 316 may be complementary to a size of top wall 210 of the respective one of mold bodies 200 in order to advantageously facilitate heat transfer to refrigerant within evaporation chambers 320.

The respective evaporation chamber 320 may be defined between circular top wall 314 and top wall 210 of the respective one of mold bodies 200. In certain example embodiments, the refrigerant within evaporation chambers 320 directly contacts top wall 210 of mold bodies 200. Thus, the water within mold bodies 200 may efficiently reject heat to refrigerant within evaporation chambers 320. By forming evaporation chambers 320 between caps 310 and mold bodies 200, an efficiency of evaporator 300 is higher than known evaporators, e.g., due to the increased contact area between the refrigerant within evaporation chambers 320 and mold bodies 200.

Evaporator 300 also includes an inlet tube 330 and an outlet tube 340. Inlet tube 330 may be configured for directing the flow of refrigerant into evaporation chambers 320. Conversely, outlet tube 340 may be configured for directing the flow of refrigerant out of evaporation chambers 320. Inlet tube 330 may have a plurality of branches 332. Each of branches 332 of inlet tube 330 may be mounted to a respective one of caps 310. Moreover, branches 332 may extend from a single trunk 334 of inlet tube 330, and each of branches 332 may extend between and fluidly connect trunk 334 to the respective one of caps 310. Outlet tube 340 may also have a plurality of branches 342. Each of branches 342 of outlet tube 340 may be mounted to a respective one of caps 310. Moreover, branches 342 of outlet tube 340 may extend to a single trunk 344 of outlet tube 340, and each of branches 342 may extend between and fluidly connect trunk 344 of outlet tube 340 to the respective one of caps 310.

Branches 332 of inlet tube 330 and branches 342 of outlet tube 340 may cooperate to connect evaporation chambers 320 in parallel. For example, the flow of refrigerant within inlet tube 330 may split from the single trunk 334 of inlet tube 330 into each of branches 332 of inlet tube 330, and each divided flow of refrigerant within branches 332 of inlet tube 330 may enter evaporation chambers 320. From evaporation chambers 320, the divided flows of refrigerant may enter branches 342 of outlet tube 340, and the divided flows of refrigerant may be recombined at the single trunk 344 of outlet tube 340. Thus, evaporation chambers 320 may be plumbed in parallel within a refrigerant loop, e.g., due to branches 332 of inlet tube 330 and branches 342 of outlet tube 340 being connected in parallel within the refrigerant loop.

Connecting evaporation chambers 320 in parallel has various benefits. For example, the quality of refrigerant within each evaporation chamber 320 may be generally consistent. Moreover, the refrigerant entering each evaporation chamber 320 may have a generally uniform temperature and/or phase state. Thus, the growth rate and/or size of ice billets formed within mold bodies 200 may be generally consistent.

It will be understood that evaporation chambers 320 may be plumbed in series within the refrigerant loop in alternative example embodiments. Thus, e.g., inlet tubes and outlet tubes may connect each of caps 310 in series such that refrigerant flows in series between evaporation chambers 320. Moreover, a single flow refrigerant may enter a first one of evaporation chambers 320, then exit the first one of evaporation chambers 320, then enter a second one of evaporation chambers 320, then exit the second one of evaporation chambers 320, etc.

Figure 10:
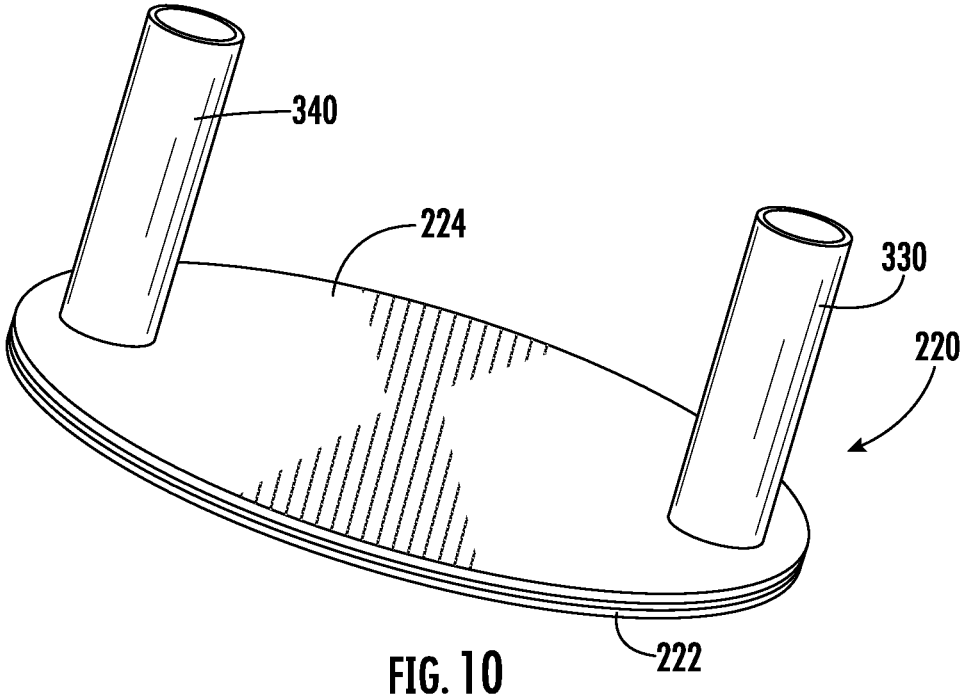
FIG. 10 is a perspective view of an insert according to an example embodiment of the present subject matter.
Figure 11:
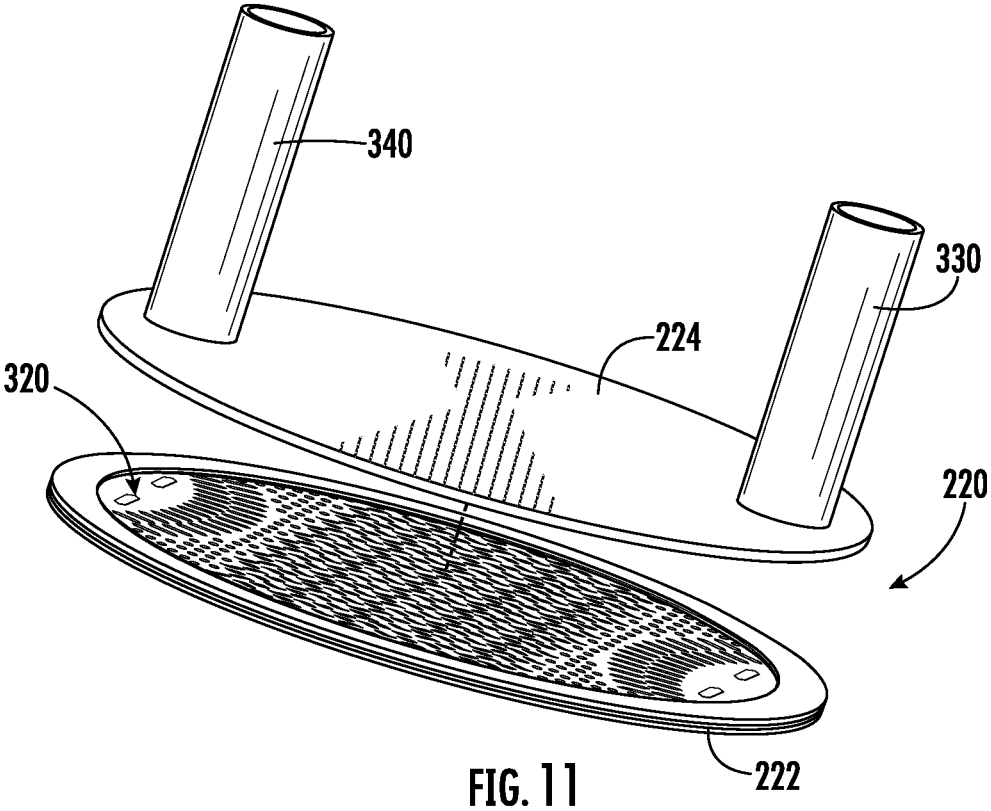
FIG. 11 is an exploded view of the example insert of FIG. 10.
Figure 12:
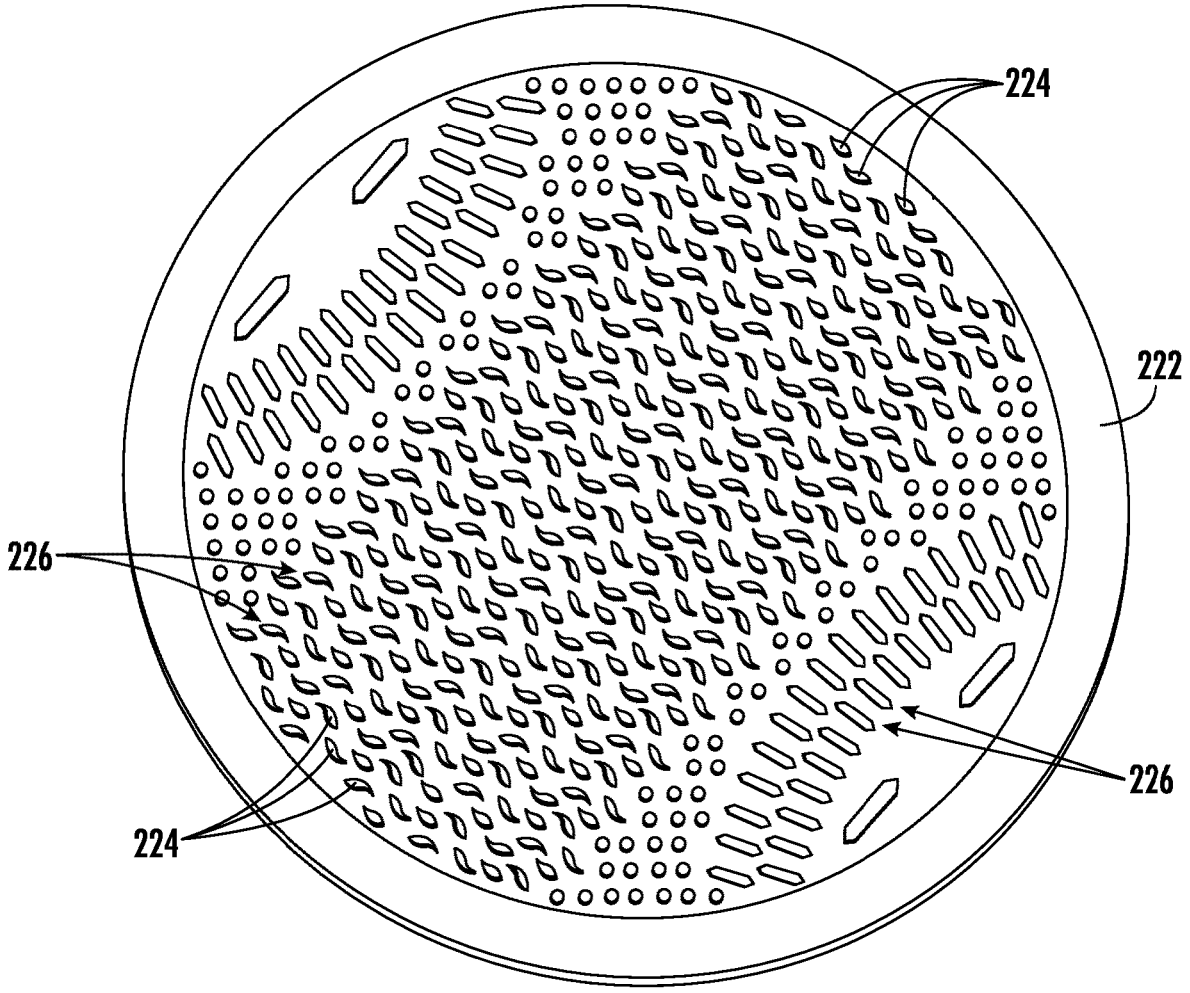
FIG. 12 is a top, plan view of a flow plate of the example insert of FIG. 10.

Referring now specifically to FIGS. 10 through 12, evaporator 300 may also include an insert 220. For example, one insert 220 may be positioned between each cap 310 and the respective one of mold bodies 200, e.g., between circular top wall 314 and top wall 210 of the respective one of mold bodies 200. In certain example embodiments, insert 220 may define evaporation chamber 320 therein. Moreover, as shown in FIGS. 11 and 12, a flow plate 222 of insert 220 may include a plurality of projections 224, and a plurality of channels 226 may be defined between projections 224. The flow of refrigerant within evaporation chamber 320 may pass between projections 224 within channels 226. Channels 226 may be positioned and shaped to facilitate uniform pressure drop and vaporization within evaporation chamber 320. A cover plate 224 of insert 220 may be mounted to flow plate 222 in order to enclose evaporation chamber 320. Inlet conduit 330 and outlet conduit 340 may be mounted to cover plate 224. Projections 224 and channels 226 may be positioned between inlet and outlet tubes 330, 340 at evaporation chamber 320. In alternative example embodiments, circular top wall 314 and/or top wall 210 of mold bodies 200 may formed with projections 224 to define channels 226.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

a plurality of mold bodies, each of the plurality of mold bodies defining a respective ice-making cavity; and an evaporator coupled to the plurality of mold bodies, the evaporator comprising a plurality of caps, each of the plurality of caps positioned on a respective one of plurality of mold bodies such that an open end of each of the plurality of caps is positioned at the respective one of the plurality of mold bodies, an inlet tube having a plurality of branches, each of the plurality of branches of the inlet tube mounted to a respective one of the plurality of caps, and an outlet tube having a plurality of branches, each of the plurality of branches of the outlet tube mounted to a respective one of the plurality of caps, wherein a respective evaporation chamber is formed between each of the plurality of caps and the respective one of plurality of mold bodies, each of the plurality of branches of the inlet tube configured for directing a flow of refrigerant into the evaporation chambers, each of the plurality of branches of the outlet tube configured for directing the flow of refrigerant out of the evaporation chambers.

2. The ice making assembly of claim 1, wherein each of the plurality of mold bodies comprises a top wall and a plurality of sidewalls that extend downwardly away from the top wall.

3. The ice making assembly of claim 2, wherein each cap of the plurality of caps is positioned on the top wall of the respective one of the plurality of mold bodies.

4. The ice making assembly of claim 3, wherein each cap of the plurality of caps is soldered to the top wall of the respective one of the plurality of mold bodies.

5. The ice making assembly of claim 2, wherein each cap of the plurality of caps comprises a circular top wall and an arcuate sidewall, the arcuate sidewall of each of the plurality of caps extending downwardly from the top wall of the cap to the top wall of the respective one of the plurality of mold bodies, the respective evaporation chamber defined between the circular top wall of each of the plurality of caps and the top wall of the respective one of the plurality of mold bodies.

6. The ice making assembly of claim 2, wherein the top wall and the plurality of sidewalls of each of the plurality of mold bodies are formed from a single sheet of copper.

7. The ice making assembly of claim 2, wherein the evaporator further comprises a plurality of flow plates, each of the plurality of flow plates disposed within a respective evaporator chamber, a plurality of projections on each of the plurality of flow plates defining a plurality of channels within the respective evaporator chamber.

8. The ice making assembly of claim 1, further comprising:

a condenser;

an expansion device; and a compressor, wherein the condenser, the expansion device, and the compressor are connected in series within a refrigerant loop, and wherein the compressor is operable to circulate the flow of refrigerant.

9. The ice making assembly of claim 8, wherein each of the plurality of branches of the inlet tube are connected in parallel within the refrigerant loop.

10. The ice making assembly of claim 8, wherein each of the plurality of branches of the outlet tube are connected in parallel within the refrigerant loop.

11. An ice making assembly comprising:

a mold body defining an ice-making cavity; and an evaporator coupled to the mold body, the evaporator comprising a cap positioned on the mold body such that an open end of the cap is positioned at the mold body, an inlet tube mounted to the cap, and an outlet tube mounted to the cap, wherein an evaporation chamber is formed between the cap and the mold body, the inlet tube configured for directing a flow of refrigerant into the evaporation chamber, the outlet tube configured for directing the flow of refrigerant out of the evaporation chamber, and wherein the evaporator further comprises a flow plate disposed within the evaporator chamber, a plurality of projections on the flow plate defining a plurality of channels within the evaporator chamber.

12. The ice making assembly of claim 11, wherein the mold body comprises a top wall and a plurality of sidewalls, the sidewalls extending downwardly away from the top wall.

13. The ice making assembly of claim 12, wherein the cap is positioned on the top wall of the mold body.

14. The ice making assembly of claim 13, wherein the cap is soldered to the top wall of the mold body.

15. The ice making assembly of claim 12, wherein the cap comprises a circular top wall and an arcuate sidewall, the arcuate sidewall of the cap extending downwardly from the top wall of the cap to the top wall of the mold body, the evaporation chamber defined between the circular top wall of the cap and the top wall of the mold body.

16. The ice making assembly of claim 12, wherein the top wall and the plurality of sidewalls are formed from a single sheet of copper.

* * * * *